US007257930B2

(12) United States Patent
Aldykiewicz, Jr. et al.

(10) Patent No.: US 7,257,930 B2
(45) Date of Patent: Aug. 21, 2007

(54) ANTICORROSION SEPARATOR FOR WOOD DECK FASTENERS

(75) Inventors: Antonio J. Aldykiewicz, Jr., Lexington, MA (US); Gerald L. Blay, Chelmsford, MA (US); Gregory N. Ciampa, Portsmouth, RI (US); Ann M. Jansen, Belmont, MA (US); Edwin C. Schaughency, Pasadena, MD (US); Lawrence S. Shapiro, Mansfield, MA (US); Albina N. Velikin, Cambridge, MA (US); Walter W. Wydra, Itasca, IL (US)

(73) Assignee: W. R. Grace & Co.-Conn., Columbia, MD (US)

( * ) Notice: Subject to any disclaimer, the term of this patent is extended or adjusted under 35 U.S.C. 154(b) by 160 days.

(21) Appl. No.: 10/736,305

(22) Filed: Dec. 15, 2003

(65) Prior Publication Data

US 2005/0126109 A1 Jun. 16, 2005

(51) Int. Cl.
*E04B 5/00* (2006.01)

(52) U.S. Cl. ..... 52/411; 52/410; 52/309.5; 52/309.7; 52/702; 52/712; 428/41.3; 428/343

(58) Field of Classification Search ..... 52/105, 52/409–411, 745.06, 746.11, 702–704, 712, 52/715, 716.2, 309.4, 309.5, 309.7, 800.1, 52/802.1

See application file for complete search history.

(56) References Cited

U.S. PATENT DOCUMENTS 4,742,654 A * 5/1988 Cole ..... 52/97
4,848,049 A * 7/1989 Hanson ..... 52/97
4,932,171 A * 6/1990 Beattie ..... 52/58
4,965,119 A * 10/1990 Sancaktar ..... 428/192
5,148,644 A * 9/1992 Weir ..... 52/300
5,198,300 A * 3/1993 Matthews et al. ..... 428/354
5,578,319 A * 11/1996 Noel ..... 424/448
5,593,748 A * 1/1997 Hubbard ..... 428/41.3
5,711,116 A * 1/1998 Hasan ..... 52/58
5,735,092 A * 4/1998 Clayton et al. ..... 52/309.9
5,737,897 A * 4/1998 Naipawer, III ..... 52/796.1
6,055,786 A * 5/2000 Hubbard et al. ..... 52/409
6,080,458 A * 6/2000 Russell et al. ..... 428/41.7
6,121,166 A * 9/2000 Wood et al. ..... 442/151
6,263,636 B1 * 7/2001 Corston ..... 52/741.1
6,295,781 B1 * 10/2001 Thompson ..... 52/712
6,410,137 B1 * 6/2002 Bunyan ..... 428/356
6,449,911 B1 * 9/2002 Hudson ..... 52/58

(Continued)

OTHER PUBLICATIONS

"Preventing Hanger Corrosion" Mike Nelson, Journal of Light Construction (JLC), pp. 12 and 14, Jan. 2004.

(Continued)

*Primary Examiner*—Carl D. Friedman
*Assistant Examiner*—Yvonne M. Horton
(74) *Attorney, Agent, or Firm*—Stephen P. Williams; Craig K. Leon

(57) ABSTRACT

Exemplary methods and assemblies for preventing corrosion of metal connector devices, e.g., zinc-galvanized joist hangers and fasteners, used for assembling outdoor structures such as decks from wood components pretreated with alkaline copper quat (ACQ), ammoniacal copper quat (ACQ-B), copper azole (CA), or mixtures thereof. Membrane barriers separate metal from wood, and seal around fasteners thus minimizing corrosion of the connector devices and fasteners.

4 Claims, 2 Drawing Sheets

U.S. PATENT DOCUMENTS

| | | | | |
|---|---|---|---|---|
| 6,505,449 | B1 * | 1/2003 | Gregori | 52/514 |
| 6,540,865 | B1 * | 4/2003 | Miekka et al. | 156/249 |
| 6,764,733 | B1 * | 7/2004 | Clarke | 428/40.3 |
| 6,780,485 | B2 * | 8/2004 | McCain | 428/40.1 |
| 6,865,858 | B1 * | 3/2005 | Pollard | 52/716.2 |

OTHER PUBLICATIONS

"New Wood Treatments May Be More Corrosive", Journal of Light Construction (JLC), p. 23 Sep. 2003.

Pressure-Treated Wood: The Next Generation, Daniel S. Morrison, Fire Homebuilding Magazine #160, pp. 82-85, Dec. 2003.

"Standard for Waterborne Preservatives", American Wood-Preservers' Association (copyright 2002) pp. 1-6.

"New Wrap improves corrosion control on North Sea lines, Servi-Wrap®", Grace Construction Products, Pipe Line Industry (Nov. 1975).

"Servi-Wrap® Protection Systems", Grace Construction Products (1982).

"Servi-Wrap®, Servi-Wrap Pipe Wrap Tapes have the dual adhesion you need", Grace Construction Products (Feb. 1981).

"Servi-Wrap® Protection Systems", Tests for Cathodic Disbondment, Grace Construction Products (before 2002).

"New Grace Servi-Wrap™ offers 5 major advantages over conventional pipe wraps", Grace Construction Products (2002).

* cited by examiner

ANTICORROSION SEPARATOR FOR WOOD DECK FASTENERS

FIELD OF THE INVENTION

The present invention pertains to the prevention of galvanic corrosion of metal fasteners used in wood assemblies, and more particularly to methods for separating zinc-coated metal from copper ions leached from pretreated wood deck components.

BACKGROUND OF THE INVENTION

Among the wood preservatives used in the last two decades for making outdoor wood constructions such as decks, chromated copper arsenate (CCA) has been the most popular. However, as arsenic is a known carcinogen, the U.S. Environmental Protection Agency (EPA) and wood preservative industry have reached agreement, effective Dec. 31, 2003, to employ less toxic alternatives.

Two such alternatives, Alkaline Copper Quat (ACQ) and Copper Azole (CA), have been approved by the American Wood Preserver's Association for outdoor use. However, the present inventors believe these new treatments can create a serious problem in that they are more likely than CCA to accelerate the corrosion of metal fasteners that are typically are used in assembling wood decks. While all of these preservatives contain copper, which can leach out of the wood and deposit as an oxide on the metal fastener, thereby creating a galvanic potential and thus oxidation and corrosion, the inventors realize that CCA contains an anodic inhibitor (chromate) and a cathodic inhibitor (arsenate) to slow down corrosion, whereas ACQ and CA do not.

The present inventors believe that without such inhibitors ACQ and CA will facilitate corrosion in metal fasteners as well as in metal "joist hangers" and other metal connector devices used in deck assemblies and other outdoor wood constructions. Certain forms of ACQ, moreover, contain chlorides that exacerabate the corrosion problem. Failure of joist hangers could lead to injury or death, and must be avoided. Although decay resistant woods (e.g., redwood, cedar), woodfiber/plastic composites, and/or stainless steel fasteners and devices can be substituted, these are all far more expensive than using common stock lumber, fasteners, and joist hangers.

A less expensive method for assembling outdoor wood structures is needed.

SUMMARY OF THE INVENTION

In resolving the aforementioned problem, the present invention provides an inexpensive and convenient method for resisting corrosion of metal connection devices (e.g., joist hangers) and metal fasteners used in assembling wood decks and other outdoor wood assembly constructions.

Exemplary methods of the present invention comprise separating, from metal connector devices, the wood components connected by the metal devices. This anomalous condition is actually deemed beneficial in the circumstances wherein at least one, or both, of the wood components is pretreated with a preservative such as alkaline copper quat (ACQ), ammoniacal copper quat (ACQ-B), copper azole (CA), or mixture thereof. A membrane barrier, comprising a carrier support layer and a pressure-sensitive waterproofing adhesive layer, is therefore used as a separator, to prevent copper from emanating from the pretreated wood under wet conditions and contacting the metal connector device (e.g., joist hanger) used for assembling the wood structure. Preferably, the membrane barrier operates to seal around metal fasteners used for securing the metal connector device to the wood components, so as to prevent water from migrating from the pretreated wood through the penetration to the metal device and metal fastener heads.

The present invention is particularly useful for minimizing galvanic corrosion of zinc-coated metal joist hangers and fasteners employed in assembling decks made from wood pretreated with ACQ, ACQ-B, and/or CA. In preferred methods, the ends of a plurality of wood joists are capped with the membrane barriers, and these ends are connected by metal connector device to the surface of a rim joists which, in turn, are covered at the point of contact with membrane barrier. Metal connector devices include metal joist hangers, plate, or braces, which are fastened to the wood by metal fasteners driven through the membrane barriers. In this manner, an entire pretreated wood construction can be assembled. The present invention therefore also pertains to wood construction assemblies provided by the above-described method.

Further advantages and features of the present invention are described in further detail hereinafter.

BRIEF DESCRIPTION OF THE DRAWINGS

The advantages and features of the invention can be more readily comprehended when the following detailed description is viewed in conjunction with the accompanying drawings, wherein.

DETAILED DESCRIPTION OF PREFERRED EMBODIMENTS

Figure 1:
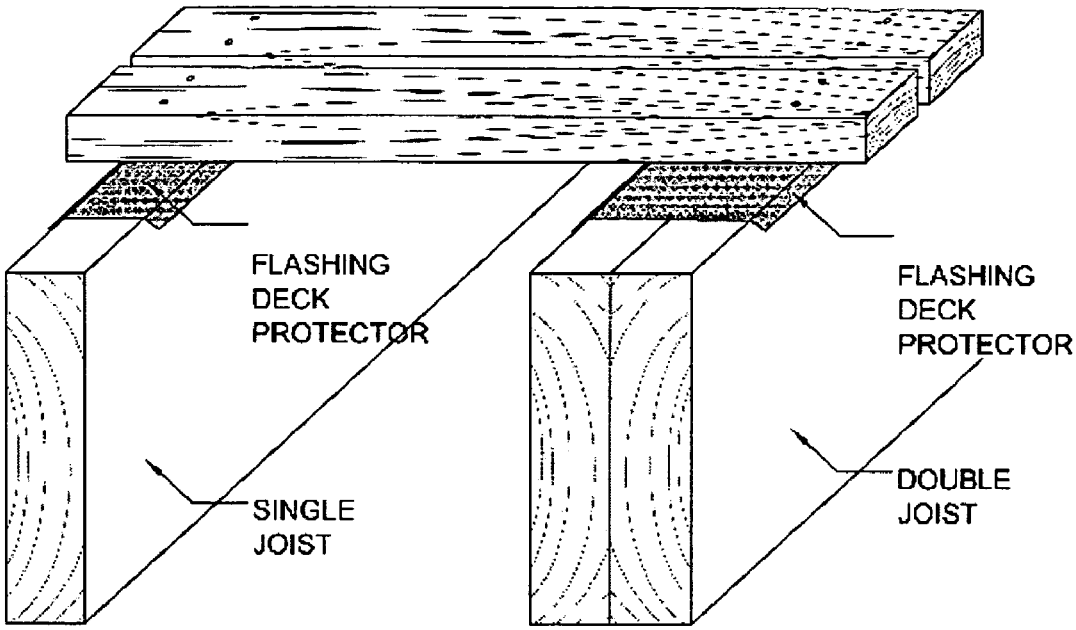
(PRIOR ART) Fig. 1.
FIG. 1 is a perspective illustration of waterproofing flashing used for preventing water from collecting between wood planks and joists in a wood deck assembly (prior art)

As shown in FIG. 1 (prior art), it is known to employ waterproofing flashing, such as self-adhesive tapes, between wood planks and underlying wood joists in a wood deck assembly structure. The objective of the flashing is to reduce or avoid water retention between these components to prevent rotting of the wood. The wood shown in this deck could be pine pretreated with chromated copper arsenate (CCA) as well as other woods, such as mahogany, cedar, redwood, or other woods as may be used in the art. Flashing strips have also been used to shunt water from the side of a building and over the "ledger board," which is essentially a wood "rim" joist used for connecting the plurality of wood joists that support the planks in a deck assembly. Consequently, water accumulation in the interface between building and deck is avoided or minimized.

In the present invention, however, the inventors believe it is equally important to employ a membrane barrier to separate the metal connector devices (e.g., joist hangers, plates, braces, typically made of galvanized steel) used for connecting wood components that have been treated with preservatives, as described herein and below.

As previously summarized above, the present invention is prompted by a recent change in the nature of wood preservatives used. Under wet conditions, the new preservatives can facilitate corrosion in the metal connection devices and metal fasteners, and particularly in zinc-coated connector devices such as joist hangers.

Preferred membrane barriers suitable for use in the invention comprise a carrier support layer, and, contiguously attached thereto, a preformed pressure-sensitive waterproofing adhesive layer. The carrier support layer is preferably plastic film or metal foil, although cloth and paper may, alternatively, be employed. Most preferred is a continuous film of cross-laminated polyethylene. The waterproofing adhesive layer is made preferably of rubberized asphalt, natural or synthetic rubber (e.g., butyl rubber, butyl rubber with EPDM), or combinations thereof. In cold weather applications, it may be advisable to employ a primer to facilitate adhesion of the pressure-sensitive adhesive to the wood surface. Thicknesses of membrane barriers can be between 10-100 mils or more, with preferred thicknesses from 20-40 mils. The thickness of the carrier support film may be 2-10 mils in thickness, while the preformed adhesive layer may be 10-75 mils, and more preferably 15-45 mils thickness. A suitable membrane barrier is commercially available from Grace Construction Products, Cambridge, Mass., under the tradename VYCOR®.

Exemplary wood assemblies of the present invention involve wood components, such as joists or beams, sheets, or other shaped components that are pretreated with one of the following preservatives, which are terms of art known in the wood preservatives trade: Alkaline Copper Quat (ACQ), which may also be referred to as ACQ-C (Type C), which contains chloride, or ACQ-D (Type D), which does not contain chloride; Ammoniacal Copper Quat, which may sometimes otherwise be referred to as ACQ-B (Type B); and Copper Azole (CA), which may sometimes otherwise be referred to as CA-A (Type A) or CA-B (Type B). The term "pretreated" as used herein may refer either to the fact that the wood has been coating or impregnating with any of the foregoing preservatives. Pretreated wood used in the present invention will typically comprise pine, and, more specifically, southern pine lumber.

Figure 2:
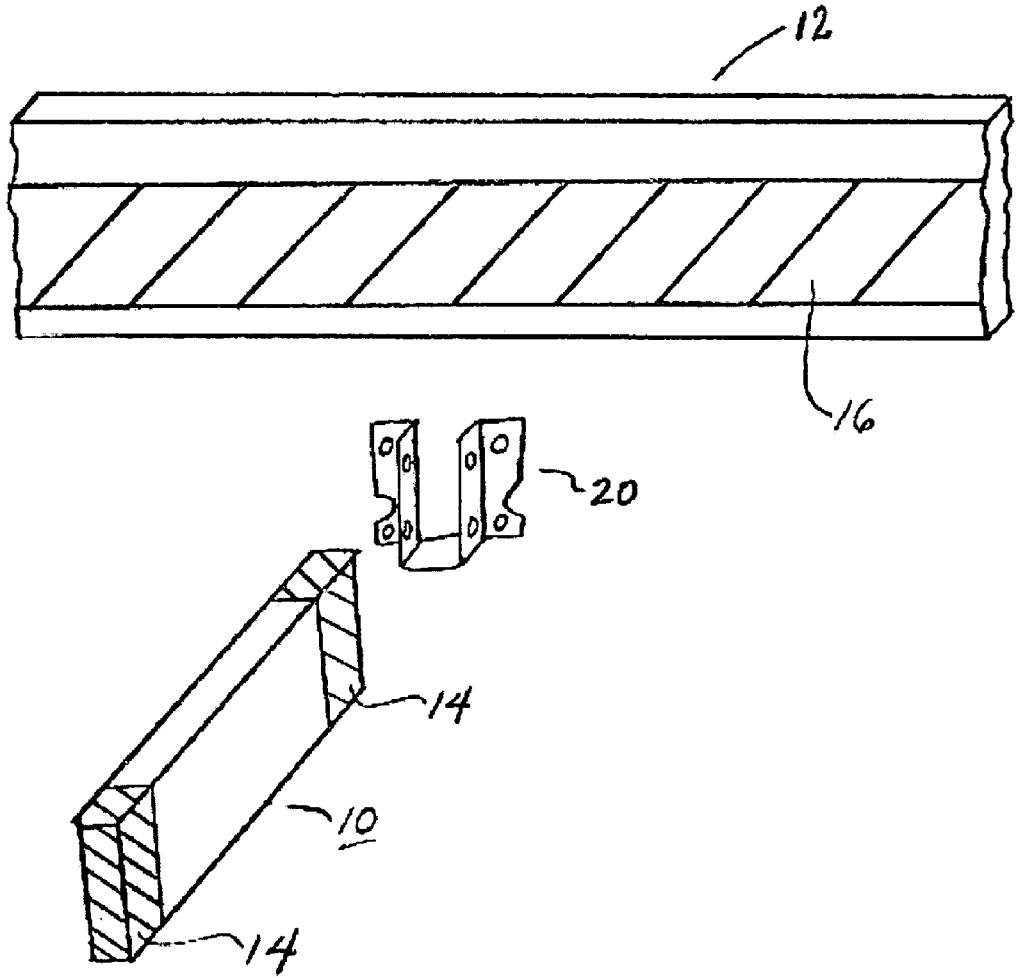
FIG. 2 is a perspective illustration of an exemplary method and wood construction of the present invention, wherein a membrane barrier is interposed between a metal joist hanger and the contact end of a wood joist pretreated with alkaline copper quat (ACQ), ammoniacal copper quat (ACQ-B), or copper azole (CA), and wherein a second membrane barrier is interposed between the metal joist hanger and a second joist (e.g., wood rim joist) also pretreated with ACQ, ACQ-B, or CA.

As illustrated in FIG. 2, an exemplary method of the present invention for minimizing galvanic corrosion of metal devices used for assembling wood constructions, comprises connecting a first wood component 10 to a second wood component 12 using a metal device 20 fastened to the wood components (10, 12) by metal fasteners (e.g., screws or nails not here illustrated), such as zinc-coated steel screws or nails; at least one of the first and second wood components (e.g., 10) being pretreated with a preservative selected from the group consisting of alkaline copper quat, ammoniacal copper quat, and copper azole; the pretreated wood component 10 having a plurality of surfaces, (preferably at least one surface of which is employed as an abutting/contacting surface for connecting said first wood component 10 and second wood component 12 together); applying onto the surface or surfaces of the pretreated wood component 10 that is intended to come into contact with the connective metal device 20 a continuous membrane barrier 14 comprising a carrier support layer and, attached thereto, a preformed pressure-sensitive waterproofing adhesive layer operative to seal around metal fasteners driven through the membrane barrier 14 to attach the metal device 20 to the pretreated wood component (10) having the contacting surface; and driving through the membrane barrier-applied, pretreated wood surface (10) at least one metal fastener (e.g., galvanized steel) to fasten, to the pretreated wood component (10), a metal device (20) to connect the first wood component 10 and second wood component 12 together.

The most prevalent form of wood components envisioned for use in the invention are beams, or joists, having elongated, generally rectangular shapes.

In further exemplary methods and assemblies of the invention, both of the wood components 10 and 12 are partially covered by membrane barrier material at the locations where they are intended to make abutting contact with each other. The reason for this is to prevent copper-carrying water or moisture from the wood to flow onto the surfaces of the metal connector device. Accordingly, it is preferred to place membrane barrier on both surfaces of the wood components where they abut, since this locating would be close to the actual contact surfaces to which the metal connector devices would be attached. The second component 12 could be a wood rim joist (otherwise called a "ledger board") to which a plurality of wood joists are connected using a number of metal connecting devices similar to the one designated at 20 in FIG. 2. The plurality of wood joists are capped 14 at their opposite ends, as shown in FIG. 2, and the surface on the wood rim joist 12 against which they are to be abutted/connected using the metal connector device 20 is also covered by a membrane barrier 16, such that the metal connector device 20 is separated from pretreated wood, and, hence, from copper or copper oxide emanating from the wood during wet conditions. The membrane barriers 14 and 16 should ideally operate to seal around the metal fasteners used for fastening the metal connector device 20 to the joists 10/12, thereby preventing water from traveling from the wood through the penetrations made by the fasteners.

Thus, while it is nevertheless advisable to cover the top of the joist 10 and rim joist 12 with membrane barrier material 14/16, as would be suggested by the prior art flashing method illustrated in FIG. 1, it has not been suggested until the present invention to separate metal connector devices from the wood components and also to provide membrane barriers having pressure-sensitive waterproofing adhesive of sufficient thickness and nature to seal around the metal fasteners, such that moisture does not penetrate through the membrane by virtue of the fastener penetration. This is particularly the case with metal screws, which can not only chew away flashing material but which can also displace the waterproofing adhesive especially where it is too thin.

The present invention will be useful not only for attaching wood joists to rim joists in wood decks, but also for connecting structural wood components together in most outdoor wood constructions, wherein the metal connector devices are preferably sheltered from the sunlight (such that the pressure-sensitive adhesive on the membrane barrier is not quickly degraded). Wood assemblies such as barns, sheds, or mail box supporting structures can also be constructed using the methods described herein.

Accordingly, in further exemplary methods and wood assemblies of the present invention, two or more wood components pretreated with ACQ, ACQ-B, or CA may be connected together using metal connector devices having a variety of shapes, such as plates or brackets (flat or bent), wherein the wood surfaces thereof for mounting the metal connector devices are protected by membrane barrier material, which operates to separate the metal connector devices from the wood components that they connect (and more importantly from the copper emanating from the wood under wet conditions), and, concomitantly, to seal around metal fasteners used for attaching the metal connector devices to wood.

It is preferably that the wood surfaces directly in abutting contact be covered as well, and not merely the wood surfaces contacted by the metal connector devices (e.g., joist hangers), since the such abutting wood surfaces could also provide a source of copper (from ACQ, ACQ-B, or CA). Hence, it is wise to "cap" the ends 14 of elongate components such as the joist 10 as shown in FIG. 2. It may be suggested to use the membrane barrier in a sparing fashion, and not to cover the entire surface of the wood structure assembly, unless means are provided for allowing moisture in the wood to evaporate, but this is a matter of personal preference.

In the case of horizontal wood joists, it is preferred to cap the opposing ends (including the very end surface and surrounding adjacent bottom and sides surfaces of the joist) to an extent commensurate with coverage required by the joist hanger or other metal connector device requiring physical contact with the wood component.

Generally, preferred methods of the invention comprise applying a membrane barrier to abutting surfaces of first and second wood components at areas whereby said first and second wood components abut or otherwise come into contact with each other, as well as to surfaces of said wood components immediately adjacent to the location where a metal connector device is used for fastening the first and second wood components together. For example, a membrane barrier can be mounted beneath a flat metal plate, corner bracket, L-bracket, such as may be used for connecting two or more wood pieces together.

In still further exemplary methods of the invention, a plurality of pretreated wood joists are capped at their opposing ends with membrane barrier, and connected to another pretreated wood structure, such as a wood rim joist or ledger board, whereby the other wood structure is also covered with membrane barrier at the point at which the pretreated joists will be connected to the pretreated structure, and metal connector devices used for fastening the joists and structure together are separated to prevent galvanic corrosion of the metal connector device due to ACQ, ACQ-B, or CA emanating from the wood.

In other exemplary embodiments, the membrane barriers may optionally contain a skid-resistant surface (e.g., polymer coating, sand granules) on the backside of the carrier support sheet opposite the adhesive layer, in order to resist skidding of foot traffic, as in the case where the tape is also used for protecting the top of joists or rim joists, or otherwise where the wood surface may be positioned to sustain foot traffic. Skid resistant coatings, as may be generally known for use on waterproofing membranes and roof underlayments, may be employed in this present context.

The present invention also provides wood construction assemblies, such as wood decks, made by the methods described above. A preferred embodiment comprises a pretreated wood deck, such as may be found on an outdoor porch or wood bridge (preferably covered wood bridge), wherein horizontal wood joists are capped by and the upper joist surfaces thereof are covered by a membrane barrier, as described above, said joists being attached to wood rim joists or ledger board at abutting regios which are covered by a membrane barrier using metal connector devices fastened to said joists using metal fasteners driven through and sealed by said membrane barrier. Wood planks are attached to said horizontal wood joists using nails or screws that are driven through the membrane barriers covering the upper surface of said horizontal wood joists. Preferably, the membrane barrier has a skid-resistant coating (preferably elastomeric coating) on the side of the carrier support sheet opposite the side on which the waterproofing adhesive layer is located, such that construction workers can walk on the exposed horizontal joists during installation of the planking.

In particularly preferred methods and construction assemblies of the invention, the membrane barrier is non-water-absorptive. For example, it is known that certain membrane barriers may, in addition to a plastic sheet carrier support and waterproofing adhesive, employ a mat (e.g., fiberglass) that can operate to absorb water. Thus, preferred membrane barriers of the invention will not contain water-absorptive components such as mats or nonwoven fabric layers.

In still further exemplary methods and embodiments, one or more wood components may be pretreated alternatively with a borate (e.g., sodium borate).

The foregoing exemplary and preferred embodiments are provided for illustrative purposes only, and not intended to limit the scope of the invention.

We claim:

1. A method for minimizing corrosion of metal devices used for assembling pretreated wood constructions, comprising capping the ends of a plurality of wood joists with a membrane barrier and connecting said capped ends to a rim wood joist at a surface of which is covered by a strip of membrane barrier, each of said wood joists and rim wood joists being pretreated with a preservative selected from the group consisting of alkaline copper quat, ammoniacal copper quat, and copper azole; said membrane barrier comprising a carrier support layer and, attached to said carrier support layer, a preformed pressure-sensitive waterproofing adhesive layer operative to seal around metal fasteners driven through said membrane barrier; and connecting said capped ends and said rim wood joists together by fastening them to metal joist hangers using metal fasteners, said metal hangers being separated from said wood joists and said rim wood joists by said membrane barriers in order to prevent contact between said pretreated joists and said metal hangers.

2. The method of claim 1 further comprising applying a membrane barrier to the uppermost surfaces of said wood joist and wood rim joist.

3. The method of claim 1 wherein said membrane barrier is non-water-absorptive.

4. The method of claim 1 wherein said metal device and metal fasteners are made of galvanized steel.

* * * * *